US008082620B2

(12) United States Patent
Hoyle et al.

(10) Patent No.: US 8,082,620 B2
(45) Date of Patent: Dec. 27, 2011

(54) MOP BUCKET AND WRINGER

(75) Inventors: Mark Allen Hoyle, Winchester, VA (US); Stephen M. Batsa, Stephens City, VA (US); Brian Michael Yarcich, Stephens City, VA (US); Ashley Perry Zang Wentz Pho, Leesburg, VA (US)

(73) Assignee: Rubbermaid Commercial Products LLC, Winchester, VA (US)

( * ) Notice: Subject to any disclaimer, the term of this patent is extended or adjusted under 35 U.S.C. 154(b) by 770 days.

(21) Appl. No.: 11/748,909

(22) Filed: May 15, 2007

(65) Prior Publication Data

US 2007/0266518 A1 Nov. 22, 2007

Related U.S. Application Data

(60) Provisional application No. 60/800,434, filed on May 16, 2006, provisional application No. 60/851,761, filed on Oct. 16, 2006.

(51) Int. Cl.
*A47L 13/58* (2006.01)

(52) U.S. Cl. ..... 15/261; 15/260

(58) Field of Classification Search ..... 15/260, 15/261

See application file for complete search history.

(56) References Cited

U.S. PATENT DOCUMENTS

| | | | |
|---|---|---|---|
| 525,803 | A | 9/1894 | White |
| 668,561 | A | 2/1901 | Goddard |
| 724,634 | A | 4/1903 | Wardwell et al. |
| 818,722 | A | 4/1906 | Wetmore |
| 942,135 | A | 12/1909 | Davis |
| 944,728 | A | 12/1909 | Flynn |
| 1,082,864 | A | 12/1913 | Gilchrist |
| 1,157,152 | A | 10/1915 | Davis |
| 2,042,209 | A | 5/1936 | Chew |
| 2,275,461 | A | 3/1942 | Palmer |
| 2,516,753 | A | 7/1950 | Chatel |
| 3,280,418 | A | 10/1966 | Schonberger |
| 3,299,458 | A | 1/1967 | Royalty |
| 3,341,876 | A | 9/1967 | Campbell |
| D250,507 | S | 12/1978 | Raftery et al. |
| 4,507,821 | A | 4/1985 | Jorgensen |
| 4,974,281 | A | 12/1990 | Shaw |
| 5,070,574 | A | 12/1991 | Delmerico et al. |
| D417,051 | S | 11/1999 | Dickinson et al. |
| 5,974,621 | A | 11/1999 | Wilen |

(Continued)

FOREIGN PATENT DOCUMENTS

| | | |
|---|---|---|
| EP | 0 824 008 A2 | 2/1998 |

(Continued)

*Primary Examiner* — Randall Chin
(74) *Attorney, Agent, or Firm* — Foley & Lardner LLP

(57) ABSTRACT

A mop bucket includes a fluid reservoir portion and a wringing portion. The fluid reservoir portion can hold fluid. The wringing portion includes a first wringing member and a second wringing member, which is moveable toward the first wringing member to wring fluid from a mop. The wringing portion further includes a linkage configured to move the second wringing member in response to actuation of a wringer handle. The linkage includes a first link extending from and pivotable relative to the second wringing member and a second link connected to the first link and having an axis that is fixed at an angle relative to an axis of the wringer handle. The second wringing member can include an integrally formed shaft about which the second wringing member rotates. A first retaining surface of the first wringing member can engage the shaft to hold the shaft at a pivot axis.

24 Claims, 6 Drawing Sheets

U.S. PATENT DOCUMENTS

| | | | | |
|---|---|---|---|---|
| D426,361 | S | 6/2000 | Young | |
| 6,128,803 | A | 10/2000 | Dickinson et al. | |
| 6,279,195 | B1 * | 8/2001 | Biggs | 15/261 |
| 6,389,638 | B1 | 5/2002 | Dickinson et al. | |
| 6,560,815 | B1 | 5/2003 | Brennan et al. | |
| 6,779,225 | B1 | 8/2004 | Bellarosa, III | |
| 6,941,612 | B1 | 9/2005 | Hirse | |
| 7,225,499 | B1 * | 6/2007 | Duncan et al. | 15/261 |
| 7,383,604 | B2 * | 6/2008 | Young | 15/261 |
| 2002/0120997 | A1 | 9/2002 | Alt | |
| 2003/0217428 | A1 | 11/2003 | Perelli | |
| 2005/0204503 | A1 | 9/2005 | Burns | |
| 2006/0048330 | A1 | 3/2006 | Rust et al. | |
| 2006/0143850 | A1 | 7/2006 | Young | |

FOREIGN PATENT DOCUMENTS

| | | | |
|---|---|---|---|
| GB | 2 242 825 | A | 10/1991 |
| GB | 2 284 979 | A | 6/1995 |
| WO | WO 00/33719 | A | 6/2000 |

* cited by examiner

MOP BUCKET AND WRINGER

CROSS-REFERENCE TO RELATED APPLICATIONS

This application claims priority from U.S. Provisional Application Nos. 60/800,434, filed May 16, 2006, and 60/851,761, filed Oct. 16, 2006, both of which are hereby incorporated herein by reference in their entireties.

FIELD

This disclosure relates to a mop bucket and, more particularly, to a mop bucket with a mop wringing portion.

BACKGROUND

Mop bucket and wringer combinations often will be configured such that the wringer is a separate member that is coupled to the rim of the mop bucket. The wringer often will include one or more movable plates, which move in response to pressure on a handle to squeeze fluid out of a mop and into the mop bucket. Such separate mop wringers may be unstable and can be prone to being knocked loose during use. Moreover, such mop wringers are often relatively complex and include a variety of components, such as metal shafts about which the plates or other components rotate. These components require significant manufacturing and assembly efforts.

There exists a mop wringer that is integral with the bucket. However, this integral mop bucket and wringer still suffers from the need for significant manufacturing and assembly efforts due to the variety of components that form the assembly.

SUMMARY

One embodiment of the invention relates to a mop bucket including a fluid reservoir portion that is configured to hold fluid and includes at least one sidewall, and a wringing portion. The wringing portion includes a first wringing member and a second wringing member which is moveable toward the first wringing member to wring fluid from a mop. The wringing portion further includes a wringer handle configured to be actuated to cause movement of the second wringing member toward the first wringing member. The wringing portion further includes a linkage configured to move the second wringing member in response to actuation of the wringer handle. The linkage includes a first link extending from and pivotable relative to the second wringing member and a second link connected to the first link and having an axis that is fixed at an angle relative to an axis of the wringer handle. The second wringing member can include an integrally formed shaft about which the second wringing member rotates. The shaft of the second link can be received within a sidewall of the wringing portion integrally formed with a sidewall of the fluid reservoir portion. The first wringing member can be ultrasonically welded to the at least one sidewall of the wringing portion and trap the shaft of the second link between the first wringing member and the fluid reservoir.

Another embodiment of the invention relates to a mop bucket including a fluid reservoir portion that is configured to hold fluid and includes at least one sidewall, and a wringing portion. The wringing portion includes a first wringing member including at least one retaining surface and a second wringing member which is moveable toward the first wringing member to wring fluid from a mop and includes a shaft about which the second wringing member moves. The wringing portion further includes a wringer handle configured to be actuated to cause movement of the second wringing member toward the first wringing member. The wringing portion further includes a linkage configured to move the second wringing member in response to actuation of the wringer handle. The first retaining surface of the first wringing member engages the shaft of the second wringing member to hold the shaft at a pivot axis. A second retaining surface is formed by the fluid reservoir. The first retaining surface and the second retaining surface can each have an arcuate shape configured to engage the shaft. The first wringing member can be ultrasonically welded to the at least one sidewall of the wringing portion and trap the shaft of the second link between the first wringing member and the fluid reservoir.

BRIEF DESCRIPTION OF THE DRAWINGS

The accompanying drawings, which are incorporated in and constitute a part of this specification, illustrate an embodiment of the invention and together with the description serve to explain principles of the invention.

DETAILED DESCRIPTION OF A PREFERRED EMBODIMENT

Figure 1:
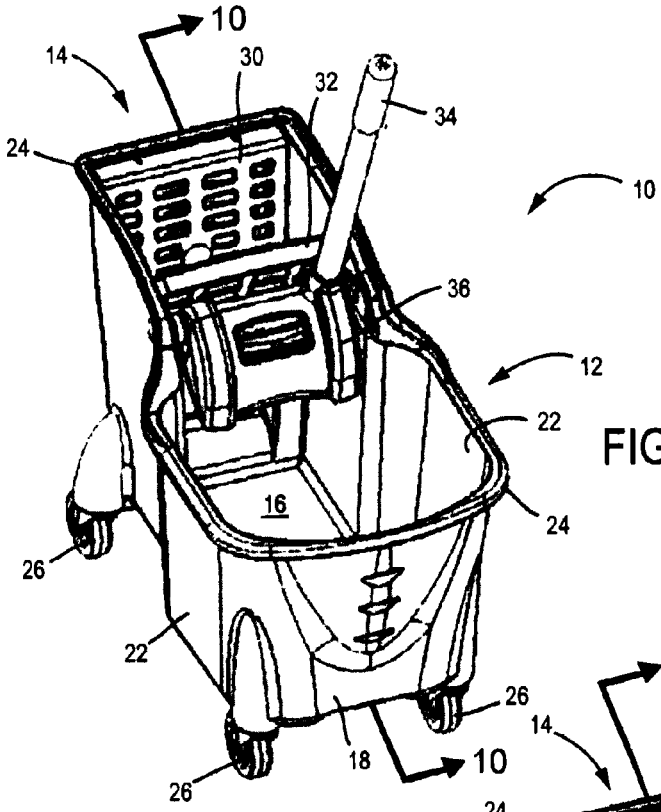
FIG. 1 is an isometric view of a first embodiment of a mop bucket with a wringing portion, wherein the wringing portion is in a first or open position.

A presently preferred embodiment of the invention is illustrated in the drawings. An effort has been made to use the same or like reference numbers to refer to the same or like parts.

Figure 2:
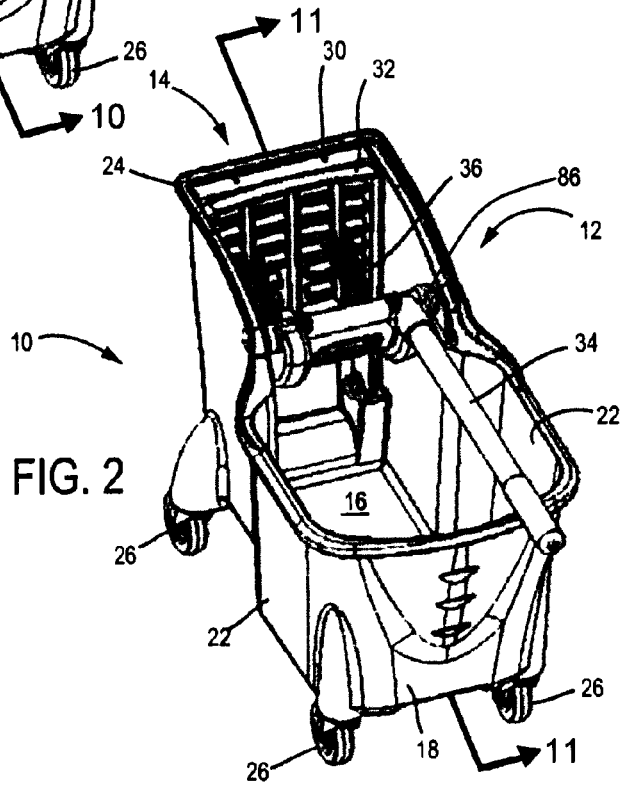
FIG. 2 is an isometric view of the mop bucket of FIG. 1, wherein the wringing portion is in a second or closed position.
Figure 3:
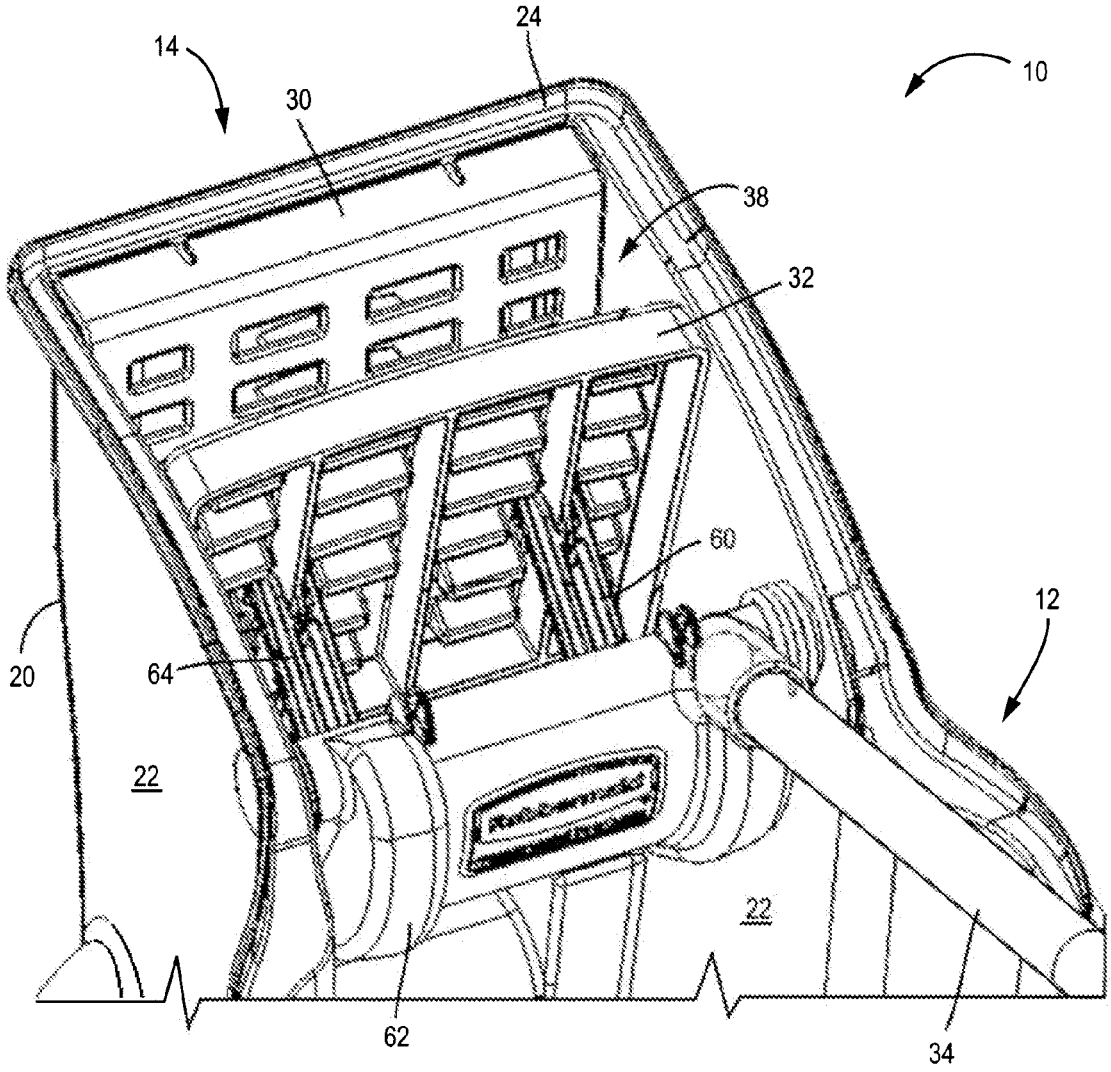
FIG. 3 is an isometric view of the mop bucket of FIG. 1 showing the wringing portion in more detail.
Figure 4:
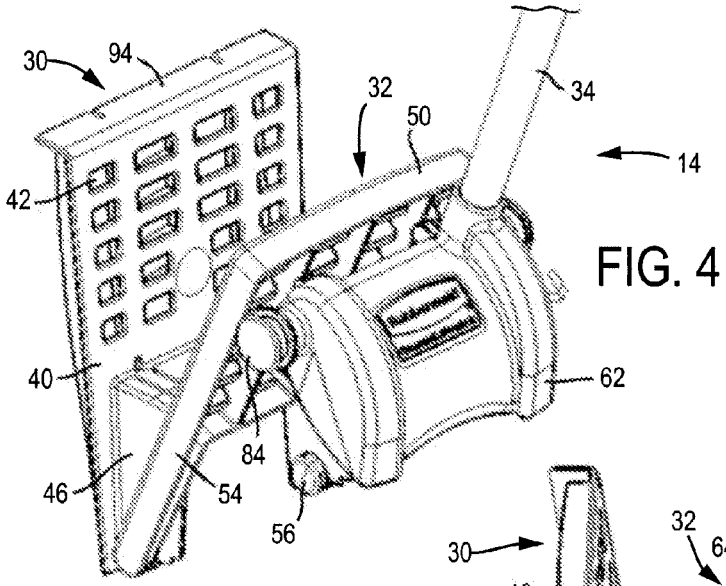
FIGS. 4-6 are isometric views of aspects of the wringing portion of the mop bucket of FIG. 1.
Figure 5:
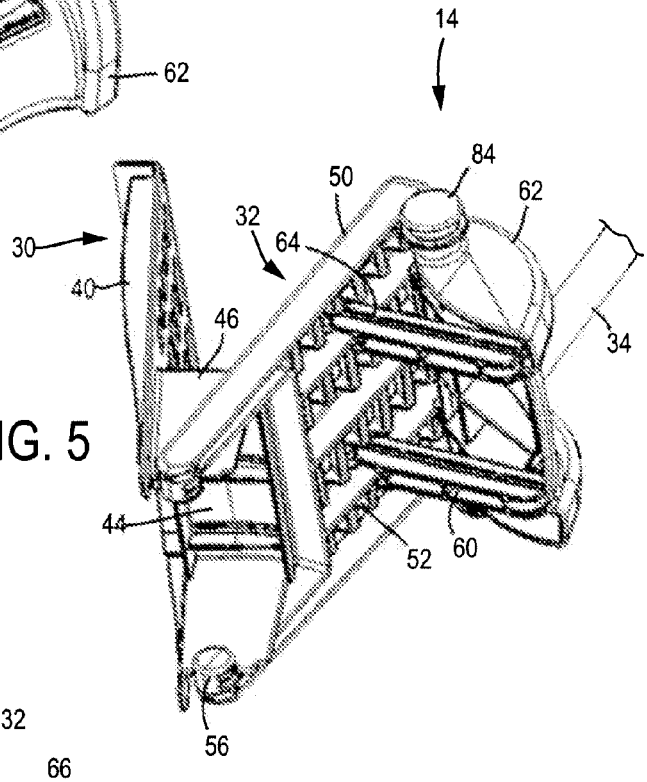
Figure 6:
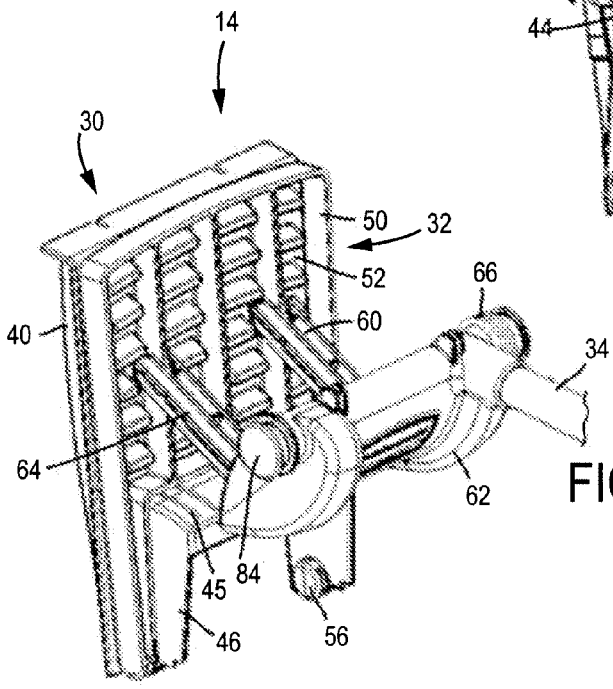

FIGS. 1-2 show an embodiment of a mop bucket 10 according to the present invention. The mop bucket 10 includes a generally hollow fluid reservoir portion 12 configured to hold a fluid and a wringing portion 14 configured to receive a mop and wring or squeeze a fluid from the mop.

The reservoir portion 12 can have a bucket-shape and include a floor or base 16 and walls or sidewalls. A front wall 18 extends upward from the floor 16, a back wall 20 extends upward from the floor 16 generally opposite of the front wall 18, and two opposing side walls 22 extend upward from the floor 16 and couple the front wall 18 to the back wall 20. The reservoir portion 12 further includes a lip or rim 24 that extends at least partially around the top edge of the front wall 18, back wall 20 and/or side walls 22. The lip 24 strengthens the reservoir portion 12 and may extend inward and/or outward from the top edge of the walls. The reservoir portion 12 further includes a multitude of rolling members 26 (e.g., casters, wheels, etc.) that allow a user to more easily move the mop bucket 20. According to an exemplary embodiment, the reservoir portion 12 is formed from an injection molded polymer such as a high-density polyethylene (HDPE) or other comparable plastic resin. According to other exemplary embodiments, the reservoir portion 12 may be formed from a metal, fiberglass, or other suitable material.

FIGS. 3-6 show in more detail an embodiment of the wringing portion 14 of the mop bucket 10. The wringing portion 14 can be provided inside the reservoir portion 12 proximate to the back wall 20. The wringing portion 14 includes a first wringing member 30, a second wringing member 32, a wringer handle 34, and a linkage 36 coupled to the handle 34 and to the second wringing member 32. The first wringing member 30, second wringing member 32, and the side walls of the wringing portion 14 form a wringer cage 38 that is configured to receive a mop (e.g., a Kentucky style mop, flat break-mop, etc.). According to an exemplary embodiment, the side walls of the wringing portion 14 are integrally formed with the side walls 22 of the reservoir portion 12. The wringer is moveable between a first or open position, shown in FIGS. 1 and 4, and a second or closed position, shown in FIGS. 2 and 6. The wringer handle 34 is manipulated to move the second wringing member 32 towards the first wringing member 30, compressing the mop between the first wringing member 30 and second wringing member 32 to wring or force a fluid from the mop.

The first wringing member 30 (e.g., fixed member, fixed plate, etc.) includes a generally planar back panel 40 with a multitude of drainage openings 42 (e.g., holes, ports, apertures, etc.) to allow fluid to pass through the first wringing member 30. The first wringing member 30 also includes a lower wall 44 (e.g., ledge, projection, base, etc.) that extends outward from the back panel 40 and forms the floor of the wringer cage 38. The lower wall 44 includes one or more drainage openings 45 (e.g., slots, apertures, holes, etc.) to allow a fluid to escape the wringer cage 38. A pair of opposing side walls 46 extend outward from the back panel 40 generally perpendicular to the lower wall 44. First retaining surfaces 48 are formed by the bottoms of the side walls 46 that are configured to retain the second wringing member 32, as will be discussed in greater detail later in the application.

The second wringing member 32 (e.g., movable member, pivoting member, pivoting plate, press plate, etc.) includes a generally planar main body 50 with a multitude of drainage openings 52 (e.g., holes, ports, apertures, etc.) to allow fluid to pass through the second wringing member 32. The second wringing member 32 further includes a pair of projections or arms 54 that extend downward from the main body 50. Shafts 56 (e.g., bosses, knobs, protrusions, etc.) extend inward from the distal ends of each of the arms 54. The shafts 56 are trapped between first retaining surfaces 48 on the first wringing member 30 and second retaining surfaces 88 on the reservoir portion 12 as will be described in greater detail later. The shafts 56 provide pivot points about which the second wringing member 32 rotates between a first position and a second position.

Figure 7:
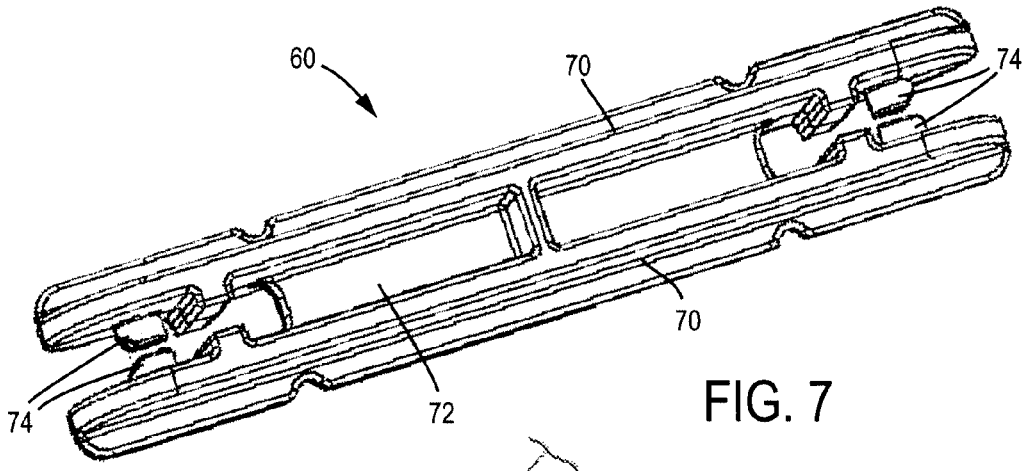
FIG. 7 is an isometric view of a first link for the wringing portion of the mop bucket of FIG. 1.
Figure 8:
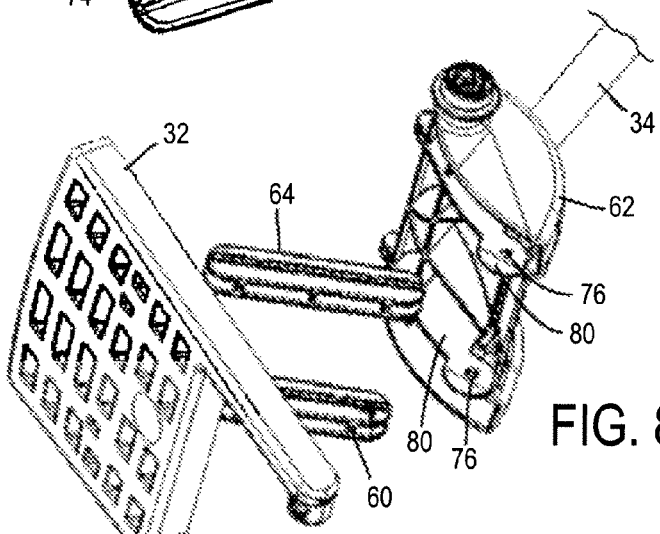
FIGS. 8-9 are exploded views of aspects of the wringing portion of the mop bucket of FIG. 1, showing the mechanisms coupling the first link to the second link and to the second wringing member.
Figure 9:
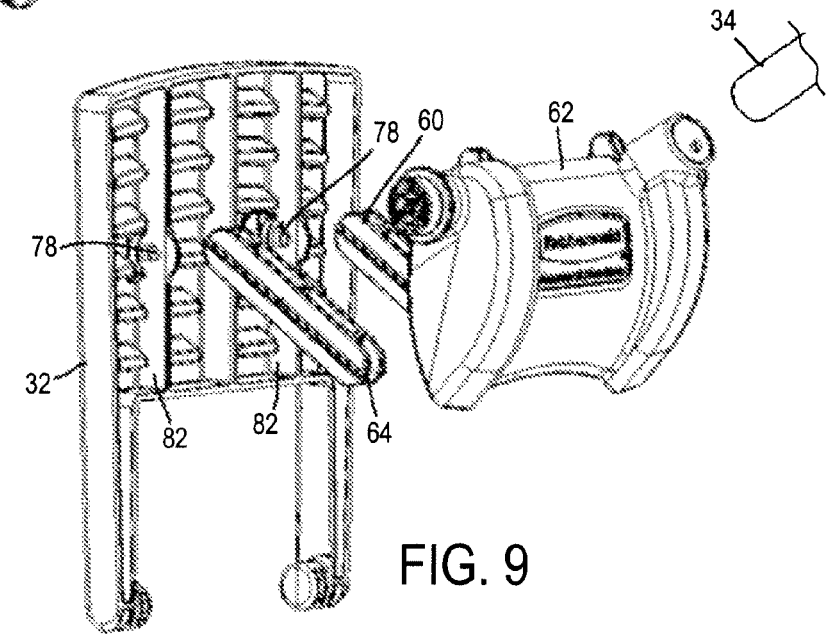

The wringer handle 34 is an elongated member or shaft that allows a user to move the wringing portion 14 between a first and second position. The handle 34 is coupled to the second wringing member 32 with a linkage 36. According to an exemplary embodiment, the linkage 36 includes a first link 60, a second link 62, a third link 64, and a biasing member 66. Referring now to FIG. 7, the first link 60 of the linkage 36 is shown. According to an exemplary embodiment, the first link 60 and the third link 64 are substantially identical members. While only the first link 60 will be described in detail, it should be understood that the third link 64 is similar to the first link 60. The first link 60 is an elongated member that includes two generally parallel flanges or walls 70 that are coupled together with a web or connecting member 72 that extends at least a portion of the length of the flanges 70. The first link 60 further includes pairs of protrusions 74 provided proximate to the ends of the first link 60. The projections 74 extend inward from the flanges 70 and are configured to engage corresponding openings 76, 78 in the second link 62 and the second wringing member 32, respectively, and provide pivot points about which the first link 60 rotates. Referring to FIG. 8 and according to an exemplary embodiment, the second link 62 includes openings 76 in generally vertical walls or ribs 80 that receive protrusions 74 on one end of the first link 60 and the third link 64. Referring to FIG. 9 and according to an exemplary embodiment, the second wringing member 32 includes openings 78 in generally vertical walls or ribs 82 that receive protrusions 74 on one end of the first link 60 and the third link 64. The distance between the opposing protrusions 74 of the first link 60 is less than the thickness of the wall 80 on the second link 62 and the wall 82 on the second wringing member 32. The first link 60 is coupled to the second wringing member 32 and the second link 62 with a snap fit when the protrusions 74 are received by the openings 76, 78.

According to other exemplary embodiments, the protrusions 74 on the first link 60 and the third link 64 may be otherwise shaped and the protrusions 74 may be provided in slots formed in the ends of the first link 60 and the third link 64. According to other exemplary embodiments, the projections 74 may be received by depressions provided on the second wringing member 32 and the second link 62.

The second link 62 is a member (arm, lever, etc.) that couples the first link 60 and the third link 64 to the wringer handle 34. The second link 62 is rigidly coupled to the handle 34 at an angle. In other words, the longitudinal axis of the wringer handle 34 extends at an angle relative to the longitudinal axis of the second link 62. Preferable the angle is within the range of 90 degrees to 170 degrees.

The second link 62 includes outwardly extending projections 84 that form an integrally formed shaft. The projections 84 are received in sockets 86 in the side walls 22 of the reservoir portion 12 and provide pivot points about which the second link 62 can rotate between a first position and a second position.

A biasing member 66 may be provided to bias the second link 62 and the rest of the wringing portion 14 towards the first position. According to an exemplary embodiment, the biasing member 66 is a torsion spring provided around one of the projections 84.

According to an exemplary embodiment, the first 30 and second 32 wringer members and the first 60, second 62, and third 64 links are formed from an injection molded polymer such as a high-density polyethylene (HDPE) or other comparable plastic resin. According to other exemplary embodiments, the first 30 and second 32 wringer members and the first 60, second 62, and third 64 links may be formed from a metal, fiberglass, or other suitable material.

Figure 10:
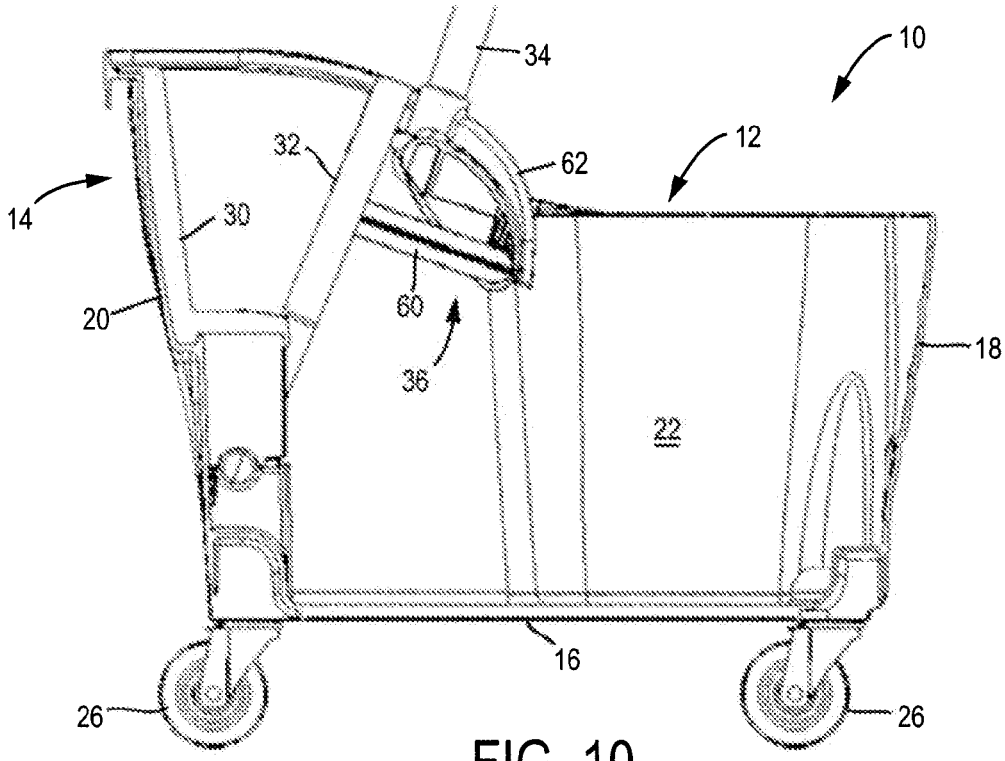
FIG. 10 is a cross-section view of the mop bucket of FIG. 1 with the wringing portion in a first position taken along line 10-10.
Figure 11:
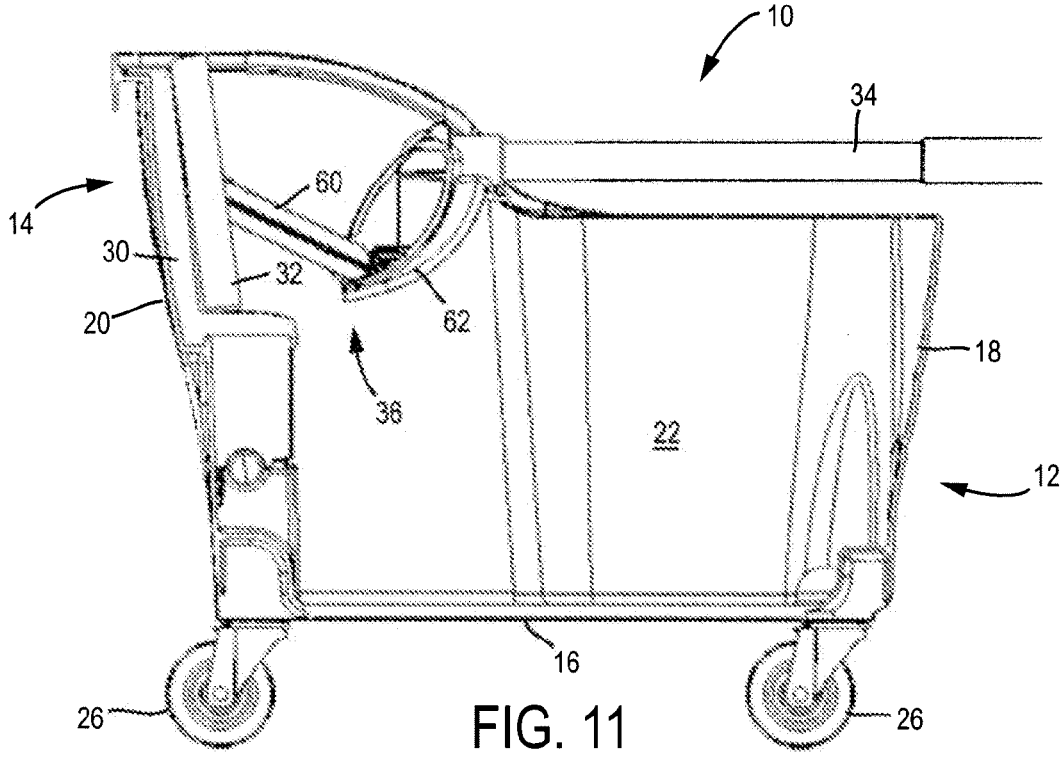
FIG. 11 is a cross-section view of the mop bucket of FIG. 2 with the wringing portion in a second position taken along line 11-11.

Referring now to FIGS. 10 and 11, the mop bucket 10 is shown according to an exemplary embodiment with the wringing portion 14 in a first position and a second position, respectively. In the first position, the handle 34 is generally upright and the second wringing member 32 is disposed at a distance from the first wringing member 30. As the handle 34 is actuated by a user towards the front wall 18 of the reservoir portion 12, the handle 34 and the second link 62 rotate about the projections 84 of the second link 62, compressing the biasing member 66. The second link 62 pushes the first 60 and third 64 links towards the back wall 20 of the reservoir portion 12. The first 60 and third 64 links rotate the second wringing member 32 about the shafts 56 of the second wringing member 32 towards the first wringing member 30. If there is no outside body (e.g., a mop) between the first wringing member 30 and the second wringing member 32, the second wringing member 32 may be allowed to contact the first wringing member 30 as the handle 34 is moved to a generally horizontal orientation (as seen in FIG. 11). If a mop is provided in the wringer cage 38, the second wringing member 32 traps the mop against the first wringing member 30 and forces a fluid out of the mop. The fluid is allowed to drain out of the wringer cage 38 through openings 42, 45, and 52 in the first wringer member 30, and the second wringer member 32. When the user releases pressure on the handle 34, the biasing member 66 urges the wringing portion 14 back towards the first position. Because the handle 34 and the rest of the wringing portion 14 move in opposite directions as it is moved between the first and second positions, the center of gravity of the wringing portion 14 is balanced, reducing the chance of the mop bucket 10 tipping over.

Figure 12:
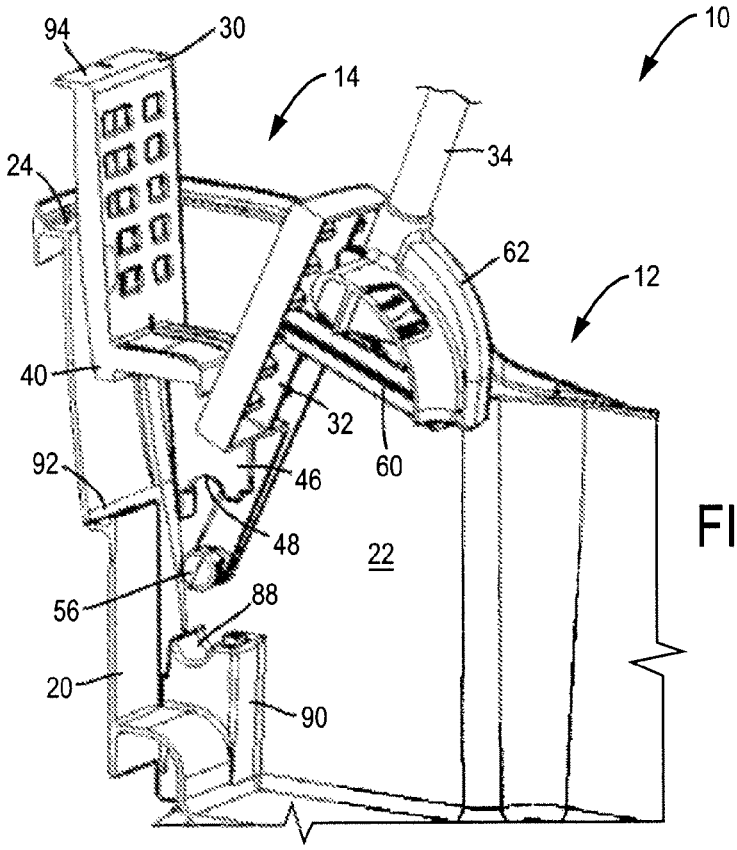
FIG. 12 is an partial exploded view of a portion of the mop bucket of FIG. 1.
Figure 13:
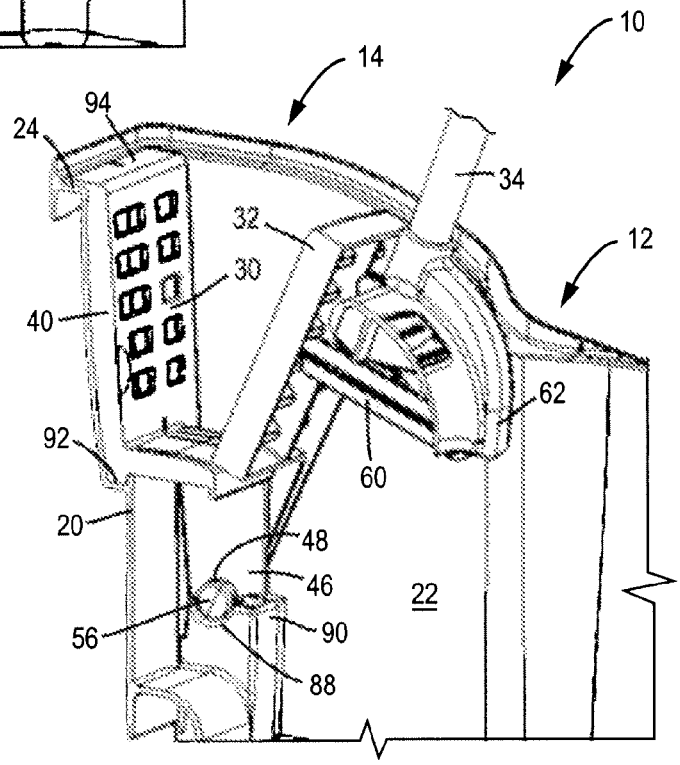
FIG. 13 is an isometric view of a portion of the mop bucket of FIG. 1 showing the first wringing member coupled to the fluid reservoir, trapping the second wringing member between the first wringing member and the fluid reservoir.

FIGS. 12 and 13 show an exemplary mechanism for coupling the wringing portion 14 to the reservoir portion 12. Second retaining surfaces 88 are provided on inwardly extending bosses 90 on the side walls 22 of the reservoir portion 12. The second retaining surfaces 88 on the side walls 22 and first retaining surfaces 48 on the first wringing member 30 are arcuate surfaces that cooperate to retain the shafts 56 of the second wringing member 32. The rim 24 of the reservoir may include an inwardly extending portion to further retain the second wringing portion 14 within the reservoir portion 12. The first wringing member 30 is mounted generally adjacent to the side walls 22 of the reservoir portion 12 and is spaced from the back wall 20 of the reservoir portion 12 to allow a fluid to drain between the first wringing member 30 and the back wall 20. The back panel 40 of the first wringing member 30 rests on a ledge 92 formed by the back wall 20 of the reservoir portion 12. The first wringing portion 14 further includes a lip 94 that rests on the rim 24 of the reservoir portion 12. According to an exemplary embodiment, the first wringing member 30 is ultrasonically welded to the reservoir portion 12 at one or more locations to couple the wringing portion 14 to the reservoir portion 12. According to other exemplary embodiments, the wringing portion 14 may be coupled to the reservoir portion 12 with welding, adhesives, mechanical fasteners, or any other suitable coupling methods. The back panel 40 of the first wringing member 30 provides additional strength and rigidity to the reservoir portion 12.

The linkage 36 and the handle 34 may be coupled to the reservoir portion 12 before or after the first 30 and second 32 wringing members are coupled to the reservoir portion 12. The projections 84 on the second link 62 are received by sockets 86 in the side walls 22 to couple the third link 64 to the reservoir portion 12. The handle 34 is coupled to the second link 62 with a thread connection, interference fit or other suitable coupling method. The first 60 and third 64 links are pivotably coupled to the second wringing member 32 and the second link 62 with snap-fit connections.

For purposes of this disclosure, the term "coupled" means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components or the two components and any additional member being attached to one another. Such joining may be permanent in nature or alternatively may be removable or releasable in nature.

Although the invention has been described above by reference to certain embodiments of the invention, the invention is not limited to the embodiments described above. Modifications and variations of the embodiments described above will occur to those skilled in the art in light of the above teachings.

What is claimed is:

1. A mop bucket comprising:

a fluid reservoir portion including a plurality of sidewalls, wherein the fluid reservoir portion is configured to hold fluid; and a wringing portion provided inside the fluid reservoir portion, the wringing portion including:

a first wringing member;

a second wringing member, which is moveable toward the first wringing member to wring fluid from a mop;

a wringer handle configured to be actuated to cause movement of the second wringing member toward the first wringing member; and a linkage configured to move the second wringing member in response to actuation of the wringer handle, wherein the linkage includes a first link and a second link, wherein the first link is directly connected to the second wringing member at a pivotable connection, wherein the second link is pivotably connected to the first link and has a longitudinal axis that is fixed at an angle relative to a longitudinal axis of the wringer handle, wherein the first wringing member is fixed to at least a first sidewall of the fluid reservoir portion such that the first wringing member is spaced from an adjacent second sidewall of the fluid reservoir portion such that fluid is capable of draining between the first wringing member and the second sidewall, wherein the first wringing member has a first surface facing the second wringing member and a second surface opposing the first surface and facing the second sidewall, and wherein an engaging portion of the first wringing member directly engages with an engaging portion of the second sidewall.

2. The mop bucket of claim 1, wherein the first wringing member has apertures therein to permit fluid to exit the mop.

3. The mop bucket of claim 2, wherein the second wringing member has apertures therein to permit fluid to exit the mop.

4. The mop bucket of claim 1, wherein the first wringing member is ultrasonically welded to the first sidewall of the fluid reservoir portion.

5. The mop bucket of claim 1, wherein the first wringing member includes a lower wall that extends substantially horizontally to support at least a portion of the mop inserted into the wringer portion.

6. The mop bucket of claim 5, wherein the lower wall has apertures therein to permit fluid to exit the mop.

7. The mop bucket of claim 1, wherein the second wringing member includes an integrally formed shaft about which the second wringing member rotates.

8. The mop bucket of claim 1, wherein the fixed angle between the longitudinal axis of the second link and the longitudinal axis of the wringer handle is within a range of 90 degrees to 170 degrees.

9. The mop bucket of claim 1, further comprising a third link extending from and pivotable relative to the second wringing member, wherein the second link is connected to both the first link and the third link.

10. The mop bucket of claim 1, wherein the second link includes an integrally formed shaft about which the second link rotates.

11. The mop bucket of claim 10, wherein the shaft of the second link is received within the first sidewall of the fluid reservoir portion.

12. The mop bucket of claim 1, wherein the engaging portion of the first wringing member comprises a panel and the engaging portion of the second sidewall comprises a ledge.

13. The mop bucket of claim 1, wherein the engaging portion of the first wringing member comprises a lip and the engaging portion of the second sidewall comprises a rim.

14. A mop bucket comprising:

a fluid reservoir portion including a plurality of sidewalls, wherein the fluid reservoir portion is configured to hold fluid; and a wringing portion including:

a first wringing member including at least one first retaining surface, the first retaining surface being a bottom-most surface of the first wringing member;

a second wringing member, which is moveable toward the first wringing member to wring fluid from a mop, wherein the second wringing member includes a shaft about which the second wringing member pivots to move toward the first wringing member;

a wringer handle configured to be actuated to cause movement of the second wringing member toward the first wringing member; and a linkage configured to move the second wringing member in response to actuation of the wringer handle, wherein the first retaining surface of the first wringing member engages the shaft of the second wringing member to hold the shaft at a pivot axis, wherein the first wringing member is directly engaged to at least a first sidewall of the fluid reservoir portion such that the first wringing member is spaced from an adjacent second sidewall of the fluid reservoir portion such that fluid is capable of draining between the first wringing member and the second sidewall, wherein the first wringing member has a first surface facing the second wringing member and a second surface opposing the first surface and facing the second sidewall, and wherein an engaging portion of the first wringing member directly engages with an engaging portion of the second sidewall.

15. The mop bucket of claim 14, wherein the first wringing member has apertures therein to permit fluid to exit the mop.

16. The mop bucket of claim 15, wherein the second wringing member has apertures therein to permit fluid to exit the mop.

17. The mop bucket of claim 14, wherein the first wringing member is ultrasonically welded to the first sidewall of the fluid reservoir portion.

18. The mop bucket of claim 14, wherein the first wringing member includes a lower wall that extends substantially horizontally to support at least a portion of the mop inserted into the wringer portion.

19. The mop bucket of claim 18, wherein the lower wall has apertures therein to permit fluid to exit the mop.

20. The mop bucket of claim 14, wherein the shaft of the second wringing member is integrally formed with remaining portions of the second wringing member.

21. The mop bucket of claim 14, wherein the first retaining surface has an arcuate shape configured to engage the shaft.

22. The mop bucket of claim 14, wherein the engaging portion of the first wringing member comprises one of a panel and a lip, and the engaging portion of the second sidewall comprises one of a ledge and a rim.

23. A mop bucket comprising:

a fluid reservoir portion including a plurality of sidewalls, wherein the fluid reservoir portion is configured to hold fluid; and a wringing portion including:

a first wringing member including at least one first retaining surface, the first retaining surface being a bottom-most surface of the first wringing member;

a second wringing member, which is moveable toward the first wringing member to wring fluid from a mop, wherein the second wringing member includes a shaft about which the second wringing member pivots to move toward the first wringing member;

a wringer handle configured to be actuated to cause movement of the second wringing member toward the first wringing member; and a linkage configured to move the second wringing member in response to actuation of the wringer handle, wherein the first retaining surface of the first wringing member engages the shaft of the second wringing member to hold the shaft at a pivot axis, wherein the first wringing member is fixed to at least a first sidewall of the fluid reservoir portion such that the first wringing member is spaced from an adjacent second sidewall of the fluid reservoir portion such that fluid is capable of draining between the first wringing member and the second sidewall, and wherein the first wringing member has a first surface facing the second wringing member and a second surface opposing the first surface and facing the second sidewall, wherein the first sidewall of the fluid reservoir portion includes a second retaining surface that engages the shaft of the second wringing member to hold the shaft at the pivot axis.

24. The mop bucket of claim 23, wherein the second retaining surface has an arcuate shape configured to engage the shaft of the second wringing member.

* * * * *